United States Patent [19]

Mayr et al.

[11] 4,010,580

[45] Mar. 8, 1977

[54] TUBULAR STRUCTURE

[76] Inventors: Gunter Mayr, Wolfschlugenerstrasse 16; Fritz Leonhardt, Lenzhalde 16; Wolfhart Andra, Lenzhalde 16; Willi Baur, Lenzhalde 16; Wilhelm Zellner, Lenzhalde 16; Jorg Schlaich, Lenzhalde 16, all of Stuttgart, Germany

[22] Filed: June 20, 1975

[21] Appl. No.: 588,868

Related U.S. Application Data

[63] Continuation-in-part of Ser. No. 401,121, Sept. 26, 1973, abandoned.

[30] Foreign Application Priority Data

Sept. 26, 1972 Germany ..... 2247179

[52] U.S. Cl. ..... 52/80; 52/222; 52/224; 261/111; 261/DIG. 11; 52/245

[51] Int. Cl.[2] ..... E04B 7/14; E04B 1/06

[58] Field of Search ..... 52/222, 80, 83, 224; 261/DIG. 11, 111

[56] References Cited

UNITED STATES PATENTS

| | | | |
|---|---|---|---|
| 2,351,121 | 6/1944 | Hart | 52/80 |
| 2,670,818 | 3/1954 | Hacker | 52/80 |
| 2,814,435 | 11/1957 | Fordyce | 261/DIG. 11 |
| 3,304,351 | 2/1967 | Sweeney | 261/DIG. 11 |
| 3,422,883 | 1/1969 | Daltry | 261/DIG. 11 |
| 3,637,193 | 1/1972 | Kugler et al. | 52/63 |
| 3,776,306 | 12/1973 | Michel | 261/DIG. 11 |
| 3,846,519 | 11/1974 | Spangemacher | 261/DIG. 11 |

FOREIGN PATENTS OR APPLICATIONS

| | | | |
|---|---|---|---|
| 79,997 | 1/1951 | Czechoslovakia | 52/80 |
| 586,020 | 10/1933 | Germany | 261/DIG. 11 |
| 2,154,530 | 2/1973 | Germany | 261/DIG. 11 |
| 1,013,285 | 12/1965 | United Kingdom | 261/DIG. 11 |
| 1,183,193 | 3/1970 | United Kingdom | 261/DIG. 11 |
| 294,046 | 7/1928 | United Kingdom | 135/1 D |

*Primary Examiner*—James L. Ridgall, Jr.
*Attorney, Agent, or Firm*—Edward F. Levy

[57] ABSTRACT

The invention relates to a structure, such as a cooling tower, comprising a waisted tubular envelope consisting of a membrane made of a material which is capable of supporting tension in all directions in its plane. The membrane is pre-tensioned and carried with its tubular axis upright from a support which provides the vertical component of the pre-tensioning.

10 Claims, 6 Drawing Figures

TUBULAR STRUCTURE

Figure 2:
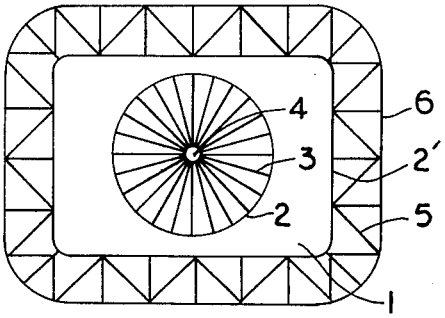

This is a continuation of copending application Ser. No. 401,121, filed Sept. 26, 1973 now abandoned.

The invention refers to tubular structures, such as so-called hyperbolic cooling towers.

It has already been proposed to manufacture the tubular envelope of such a structure from a three-family cable construction clad or overlaid with plates, and essentially airtight. In contrast to two-family constructions consisting of cables running in straight lines a three-family cable construction has the considerable advantage that only slight deformations result from considerable wind pressures. The cladding is thus subjected to no disadvantageous stresses and the high inherent stability further avoids the danger of fluttering of the envelope. An envelope of this kind is however expensive because the envelope is divided between two groups of members. The cable construction undertakes the supporting and bearing function, whereas the cladding serves for the sealing.

The object of the invention is to provide the envelope in such a way that it can be produced and erected more simply and cheaply.

According to the invention a structure comprises a waisted tubular envelope consisting of a membrane made of a material which is capable of supporting tension in all directions in its plane, the membrane being pretensioned and carried with its tubular axis upright from a support which provides the vertical component of the pretensioning.

The resulting advantage lies in the fact that a very thin-walled membrane can be used, so long as the material is tension-resistant in all directions. Pretensioning confers on the envelope an excellent inherent stability after erection, i.e., the envelope acts as a true diaphragm-shell. The pretension is chosen to be such that the compressive forces exerted within the diaphragm-shell by wind loading remain smaller than the tensile forces produced by the pretensioning.

It must be emphasized that the employment of compression-resistant material for the envelope can be completely dispensed with. This is significant particularly compared with the generally customary shells of concrete in which the compressive forces to be borne introduce considerable problems of stability. The dimensions of conventional concrete structures are thereby limited because of the construction of the envelope. The envelope according to the invention on the contrary enables the production of considerably larger structures.

The new envelope may be made of, for example aluminium, steel, laminates, especially laminated fabrics, and plastics. Fundamentally the envelope can have any cross-section whatever. Thus it is possible for its cross-section to be rotationally symmetrical.

Preferably, however, its cross-section at least at its bottom is approximately rectangular or square. This offers the possibility of accommodating rectangular or square components with optimum utilization of space. This is important in connection with cooling towers, since the frames provided in the lower zone for the introduction of the medium to be cooled have as a rule a rectangular or square shape.

The membrane may be attached, at least at its upper end to a supporting and stiffening ring. The ring in turn may be carried from a mast extending up through the envelope and providing the reaction for the vertical pretension. The spoked wheel construction formed in this manner to a considerable extent reduces the maximum shear forces which arise as a result of the wind loading.

The structure may have, at the bottom of the envelope a latticework of diaphragm tongues, cables or rods, which forms essentially triangular openings. This latticework serves to conduct the forces resulting from wind loading and pretension via a foundation into the subsoil. Because of the triangular form of the openings provision is made for the latticework to become, as regards its supporting behaviour, a component of the envelope. In the case of employment as a cooling tower the cooling air can flow into the envelope through these openings.

Preferably the membrane is composed of prefabricated members attached to one another, the members consisting of plates, axial strips, truncated cone-shaped sections or a strip wound in the shape of a helix. The number of prefabricated members employed depends upon the kind of material selected, i.e., upon its ability to adapt itself to a waisted shape.

Figure 1:
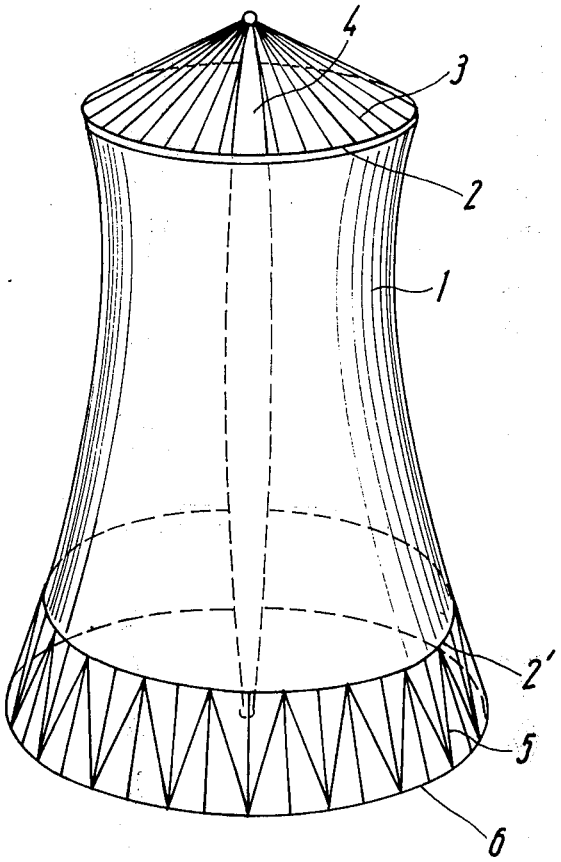

Additional objects and advantages of the invention will become apparent during the course of the following specification when taken in connection with the accompanying drawings, in which:

FIG. 1 is a diagrammatic elevational view of one embodiment of a natural-draught cooling tower constructed in accordance with the invention;

FIG. 2 is a diagrammatic top plan view of another embodiment of cooling tower made in accordance with the invention, the tower having a rectangular base; and FIGS. 3, 4, 5 and 6 are fragmentary views of a portion of the envelope for the cooling tower, showing the manner in which the envelope may be formed respectively of plates, axial strips, truncated cone-shaped sections, or a single helically-wound strip.

The tower has an envelope 1 consisting of a membrane which is tension-resistant in all directions in its plane. At the upper end of the envelope a supporting and stiffening ring 2 is attached. Cables 3 engage this supporting and stiffening ring, by which the envelope is suspended from a central mast 4. At the lower end of the envelope there is a latticework 5, which provides a connection to a foundation 6.

The envelope membrane is stretched between the foundation and the top end of the central mast. It forms the shape of a rotationally symmetrical waisted surface and acts as a true diaphragm-shell.

The latticework 5 forms in the present case a component of the envelope and because of the triangular shape of its openings is in the position to convey into the foundation the forces resulting from wind loading and pretensioning. The openings furthermore allow the access of cooling air to the interior of the cooling tower.

The latticework is connected to the envelope by a further supporting and stiffening ring 2'. Additional stiffening rings of the kind can be distributed over the height of the envelope. In conjunction with prestressed spokes they serve to reduce still further the shear forces resulting from the wind loading, and so long as the spokes run obliquely upwards to the central mast, to adapt the pretension better to the variation of the shear forces over the height of the diaphragm-shell.

FIG. 2 shows a modified form of cooling tower in which the lower stiffening ring 2' is made of rectangular shape instead of the circular shape shown in FIG. 1. This results in the tower having a lower portion of rectangular cross-section enabling the tower to fit freely over rectangular cooling apparatus.

Figure 3:
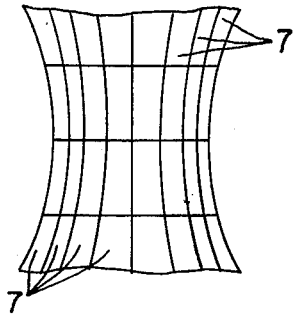
Figure 4:
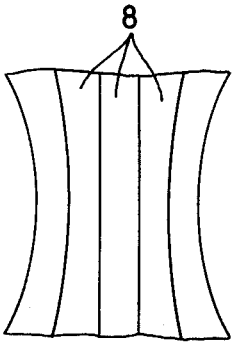
Figure 5:
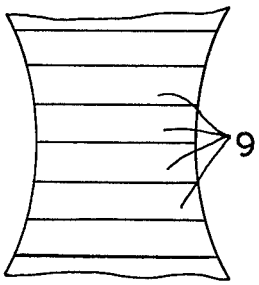
Figure 6:
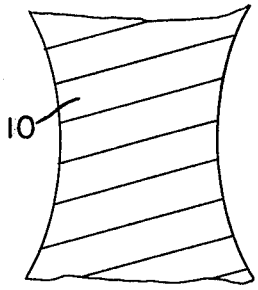

As previously indicated, the membrane forming the envelope 1 of the tower is preferably composed of prefabricated elements attached to one another. FIG. 3 shows the membrane formed of a plurality of individual, generally-rectangular plates 7 which are attached to each other to form the completed envelope 1. FIG. 4 shows, by way of example, the membrane formed of a plurality of interconnected axially-extending strips 8, while FIG. 5 illustrates a plurality of attached horizontal strips 9 forming the membrane of envelope 1. The horizontal strips are in the form of truncated cone-shaped sections. FIG. 6 shows the membrane formed of a single elongated strip 10 wound in helical form with each turn attached to adjacent turns along its longitudinal edges.

While preferred embodiments of the invention have been shown and described herein, it is obvious that numerous omissions, changes and additions may be made in such embodiments without departing from the spirit and scope of the invention.

We claim:

1. An industrial cooling tower comprising a support structure resting on a ground surface and a waisted tubular envelope consisting of a continuous membrane having an unbroken surface of saddle shape and made of a material which is capable of supporting tension in all directions in its plane, said membrane being pre-tensioned and carried with its tubular axis upright from said support structure, an open latticework anchoring the lower border of said membrane to the ground surface and providing an inlet for entry of cooling air into the interior of said membrane, said membrane having an open upper end serving as an air outlet opening and a ring connected to the upper border of said membrane and to said support structure with said envelope stretched in an axial direction between its upper and lower borders, and with said support structure providing the vertical component of said pre-tensioning, said support structure being of sufficient strength to support said membrane in a sufficiently stretched condition to cause said pre-tensioning to create tensile forces in said membrane in all directions in the plane of said waisted envelope, with said tensile forces being greater than the compression forces created by the wind externally to said shell, whereby said tensioned membrane becomes a self-supporting membrane shell.

2. An industrial cooling tower according to claim 1, wherein the cross section of said tubular envelope has rotational symmetry.

3. An industrial cooling tower according to claim 1, wherein the cross section of said tubular envelope at least at its bottom is substantially rectangular or square.

4. An industrial cooling tower according to claim 1 in which said lattice work is formed of diaphragm tongues, cables or rods, forming essentially triangular openings at the bottom of said envelope.

5. An industrial cooling tower according to claim 1 wherein said membrane is composed of pre-fabricated plates attached to one another.

6. An industrial cooling tower according to claim 1 wherein said membrane is composed of pre-fabricated axial strips attached to one another.

7. An industrial cooling tower according to claim 1 wherein said membrane is composed of truncated cone-shaped sections attached to one another.

8. An industrial cooling tower according to claim 1 wherein said membrane is composed of a pre-fabricated strip wound in the shape of a helix with its adjacent longitudinal edges attached together.

9. An industrial cooling tower according to claim 1, wherein at least at its upper border said envelope is attached to a supporting and stiffening ring.

10. An industrial cooling tower according to claim 11, wherein said ring is carried from a mast extending up through said envelope, and supported on said ground surface.

* * * * *